United States Patent [19]

Kinnavy

[11] 3,991,915

[45] Nov. 16, 1976

[54] AEROSOL CONTAINER

[75] Inventor: James W. Kinnavy, DuPage, Ill.

[73] Assignee: Continental Can Company, Inc., New York, N.Y.

[22] Filed: Mar. 18, 1971

[21] Appl. No.: 125,831

Related U.S. Application Data

[63] Continuation of Ser. No. 810,572, March 26, 1969, abandoned.

[52] U.S. Cl. ..... 222/394

[51] Int. Cl.[2] ..... B65D 83/14

[58] Field of Search ..... 222/92, 94, 394, 464, 222/402.1–402.25; 220/60, 67, 1; 9/194, 144, 143, 8

[56] References Cited

UNITED STATES PATENTS

| | | | |
|---|---|---|---|
| 1,486,041 | 3/1924 | Schmidt | 222/394 |
| 2,119,502 | 5/1938 | Bertels | 220/66 X |
| 2,494,793 | 1/1950 | Boe | 222/394 |
| 2,512,105 | 6/1950 | Kooij et al. | 222/394 X |
| 2,552,857 | 5/1951 | Knapp | 222/402.24 X |
| 3,171,571 | 3/1965 | Daniels | 222/464 |
| 3,236,417 | 2/1966 | Linton | 222/92 |
| 3,270,924 | 9/1966 | Kitabayashi | 222/394 |
| 3,301,438 | 1/1967 | Tillotson | 222/402.1 X |
| 3,347,419 | 10/1967 | Brandt et al. | 222/107 |
| 3,349,974 | 10/1967 | Raehs | 222/394 |
| 3,519,171 | 7/1970 | Kinnavy | 222/394 |

FOREIGN PATENTS OR APPLICATIONS

| | | | |
|---|---|---|---|
| 858,349 | 5/1940 | France | 222/394 |

*Primary Examiner*—Stanley H. Tollberg
*Assistant Examiner*—Norman L. Stack, Jr.
*Attorney, Agent, or Firm*—Diller, Brown, Ramik & Wight

[57] ABSTRACT

An aerosol container having a body formed of substantially circular cross-section at the upper end and gradually tapered intermediate the ends thereof and merging with a substantially V-shaped trough at the lower end.

4 Claims, 3 Drawing Figures

AEROSOL CONTAINER

This application is a continuation of Ser. No. 810,572, filed Mar. 26, 1969, and now abandoned.

The present invention relates to aerosol containers and more particularly to a new and improved container body for such containers.

Aerosol containers generally comprise a tubular body portion having a domed end closures at opposite ends thereof. The container is filled with a fluid product to be dispensed and is mixed with a propellant so as to be pressure discharged from the container through a dispensing valve. Associated with the dispensing valve is a dip tube which extends toward the bottom of the container.

Heretofore, aerosol containers have generally been of a cylindrical shape with the bottom end closure being either flat or concavely domed. This structure requires the tilting of the container to empty the contents remaining at the bottom of the container through the dip tube and dispensing valve. Generally, the user of the aerosol container did not bother with the tilting because of the difficulty in aligning the intake end of the dip tube with the residual contents. For this reason maximum dispensing of the container contents was not always achieved and a portion of the contents remained in the bottom of the container.

Moreover, in recent years aerosol containers containing personal products such as hair sprays, deodorants and the like have been miniaturized so as to be adaptable to being carried in a hand bag for ready use. However, when the miniaturized containers are constructed in accordance with the past practice the cylindrical body causes the hand bag to bulge and thereby creates an unslightly appearance. Moreover, because of the limited contents of the miniaturized container, it is even more desirable that substantially all of the product be dispensed from the container. With the conventional cylindrical party, such maximum output could not be achieved for the simple reason that it is difficult to insert the dip tube into the liquid at the bottom of the container.

By the present invention is proposed to provide an aerosol container having a body which is constructed so as to minimize the bulk and at the same time achieve a maximum product output.

In accordance with the present invention there is provided an aerosol container having a body which is constructed so that the upper end thereof is formed with a generally circular cross-section and gradually tapering downwardly to form a V-shaped trough at the lower end thereof. The V-shaped trough accommodates the input end of the dip tube so as to assure maximum utilization of the product in the lower end of the container.

Figure 1:
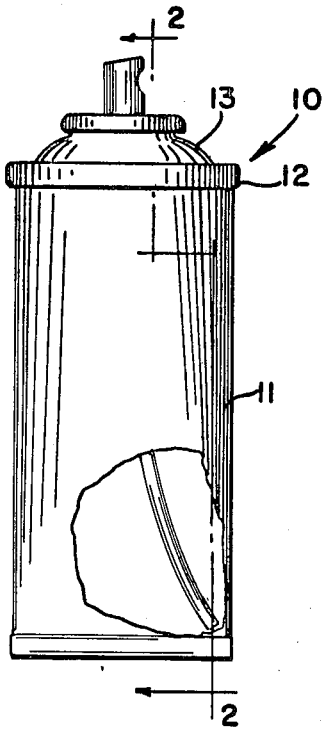
FIG. 1 is an elevational view of an aerosol container embodying the structure of the present invention.
Figure 2:
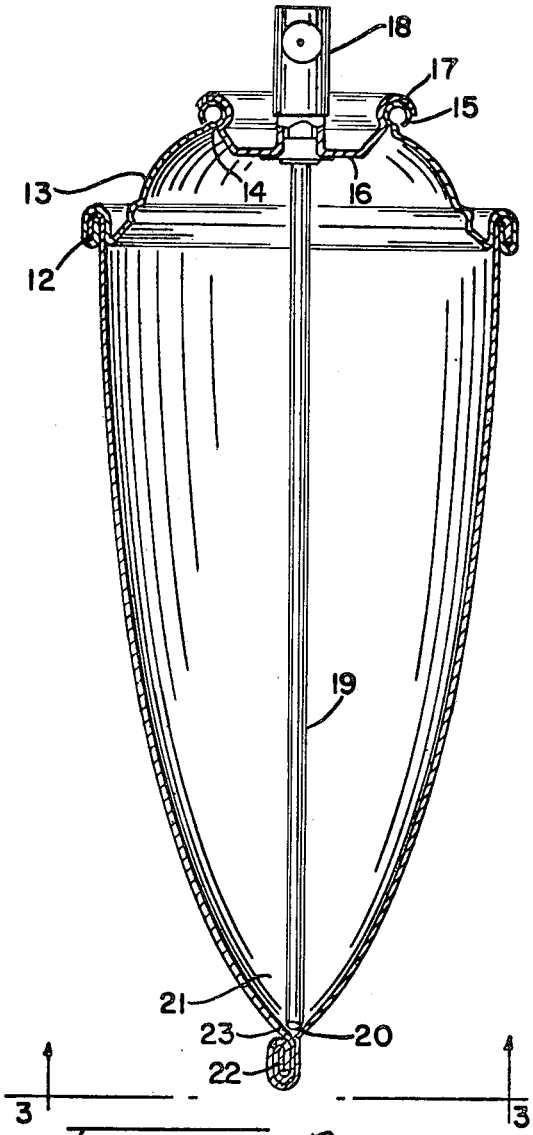
FIG. 2 is an enlarged cross sectional view taken generally along the lines 2—2 of FIG. 1.
Figure 3:
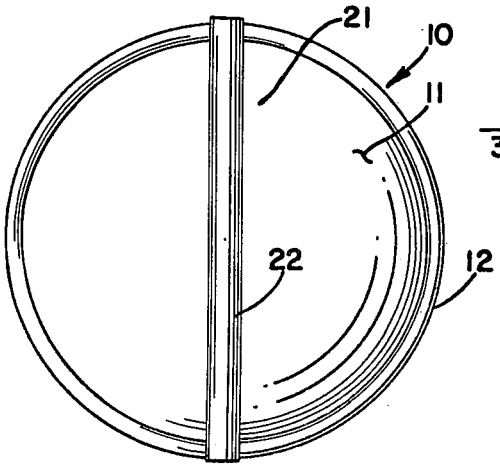
FIG. 3 is a bottom view of the container.

Referring now to the drawings there as shown an aerosol container 10 embodying the structure of the present invention. The container 10 comprises a container body 11 to the upper end of which there is attached by means of a double seam 12 a dome end closure 13 having an opening 14 defined by a curled rim 15. Seated within the opening 14 is a cup shaped disc 16 having a curled periphery which is clinched to the curl rim 15. The cup shaped disc supports a dispensing valve 18. The dispensing valve 18 may be of any well known structure which upon tilting or depression thereof provides a discharge passage through which the contents of the container are discharged.

To assure maximum utilization of the product, a dip tube 19 is connected to the inner end to the dispensing valve 18. As shown, the dip tube 19 extends downwardly to the bottom of the container so that the intake end 20 is disposed in close proximity to the bottom.

In accordance with the present invention, the container body 11 is formed so as to reduce the bulk, assure maximum utilization of the contents within the container, and provide a convenient shape which can be readily grasped in the palm of the user.

To this end, the container body 11 is preferably made from metal by drawing or extrusion from a disc. In this manner, the body 11 is formed to eliminate the side seam structure which is required when the body is formed from a flat sheet. The body 11 is then reshaped so that the upper end is of generally cylindrical or circular cross section. The wall of the body is also gradually tapered downwardly from the circular cross section so that the lower end defines a substantially V-shaped trough 21. The lower merging ends are curled about themselves so as to form in the nature of a double seam 22. It is to be understood that while the double seam 22 is adequate to form a fluid tight seal at the lower end of the container, different seaming structures may also be used such as, for example a separate piece of metal which may be clinched to the abutting lower end of the trough.

It is to be noted that the intake end 20 of the dip tube 19 is disposed in close proximity to the vortex 23 of the trough 21. Moreover, as shown, the dip tube 19 is somewhat curled so that it extends toward one of the corners of the trough 21. From the foregoing, it should be readily apparent that when the liquid or contents of the aerosol container 10 is substantially empty that upon tilting the residue of the contents may be entrapped within the corner of the V-shaped trough 22 into which the dip tube 19 extends. Thus, upon tilting in this direction, substantially all of the product or contents remaining at the bottom may be dispensed through the dip tube 19 and valve 18.

Moreover, the tapered shape of the container body 11 at the lower end thereof reduces the bulk so that the container may be conveniently stored in a hand bag or other personal luggage. The tapered 22 lower end also permits the container 10 to be easily grasped in the palm of a hand of the user so that it can be effectively manipulated during dispensing of the product.

What is claimed is:

1. An aerosol container comprising a one-piece rigid container body, said container body being substantially circular in cross section at one end and gradually changing in cross section to a straight line bottom at the other end with said container body being of a trough section at said other end, said bottom wall being of a length substantially equal to the diameter of said circular cross section, a closure element closing said container body one end, a dispensing valve carried by said closure element, and a dip tube depending from said closure element from in communication with said dispensing valve through said container body into said trough section and terminating at said straight line bottom.

2. The invention as defined in claim 1 wherein said other end of said container body is folded over in the form of a double seam.

3. The invention as defined in claim 1 wherein said dip tube terminates at one end of said bottom.

4. The invention as defined in claim 1 wherein said container body is of an extruded one-piece metal construction.

* * * * *